US007219986B2

(12) United States Patent
Nip

(10) Patent No.: US 7,219,986 B2
(45) Date of Patent: May 22, 2007

(54) INK CARTRIDGE FOR INK-JET PRINTER

(75) Inventor: Shui Kuen Nip, Wanchai (HK)

(73) Assignee: Powerful Way Limited, North point (HK)

( * ) Notice: Subject to any disclaimer, the term of this patent is extended or adjusted under 35 U.S.C. 154(b) by 302 days.

(21) Appl. No.: 11/055,659

(22) Filed: Feb. 11, 2005

(65) Prior Publication Data

US 2006/0181584 A1 Aug. 17, 2006

(30) Foreign Application Priority Data

Sep. 6, 2004 (CN) ..... 2004 2 0091268

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS 4,598,303 A * 7/1986 Peekema et al. ..... 347/71
5,305,916 A * 4/1994 Suzuki et al. ..... 222/52
5,737,002 A * 4/1998 Swanson et al. ..... 347/86
6,145,973 A * 11/2000 Wu et al. ..... 347/86
6,168,267 B1 * 1/2001 Komplin ..... 347/86
6,247,807 B1 * 6/2001 Yang et al. ..... 347/87
6,929,357 B2 * 8/2005 Qingguo et al. ..... 347/85
7,090,341 B1 * 8/2006 Miyazawa ..... 347/85

* cited by examiner

*Primary Examiner*—Anh T. N. Vo
(74) *Attorney, Agent, or Firm*—Rabin & Berdo, P.C.

(57) ABSTRACT

An ink cartridge for ink-jet printer where the ink cartridge comprises an ink supply adjusting valve, air vent valve, and ink storage chamber. Ink supply adjusting valve includes an ink inlet communicates in ink fluid communication with the ink storage chamber and an ink outlet connected with ink-supply port of ink storage chamber and a valve body constructed of a film and holder thereof and in which at least two small ink chambers are partitioned and both of the small ink chambers are communicated through a small ink channel. Air vent valve is a normal-closed one-way valve controlled by elastic valve cap under the level of ink fluid inside the ink storage chamber. Under static equilibrium during operation, suction of print head causes higher negative pressure inside the ink storage chamber and air vent valve is opened by atmosphere pressure, and ink flows into the ink supply adjusting valve.

9 Claims, 3 Drawing Sheets

IV – IV

INK CARTRIDGE FOR INK-JET PRINTER

BACKGROUND OF INVENTION

1. Field of Invention

The present invention relates to an ink supply device, and more particularly to an ink cartridge for supplying ink to the print head of ink-jet printer.

2. Description of Related Art

In general, ink cartridge inside an ink-jet printer has a cartridge body filled with ink. The ink is printed on the surface of paper through the ink outlet of ink cartridge. Known ink cartridge can be substantially classified into two types: ink cartridges with absorption material and ink cartridges without absorption material. Most of the conventional ink cartridges possess absorption material, such as a sponge or the like, but such the absorption material not only occupies the space of ink storage chamber of ink cartridge, but also left therein large amount of ink. Once discarded, the environment will be polluted. In addition, due to that it is difficult to recycle, works on environmental protection become complicated. Ink cartridge without absorption material can avoid the said defects. For example, Chinese Patent No. 0326813.9 discloses an printer's ink cartridge with valve in which a negative pressure on the ink outlet of the ink cartridge is kept by means of a pressure regulator mechanism which is comprised of a front valve body, a rear valve body, a valve film, a spring etc. Even though such a mechanism may continuously and uniformly supply the ink and assure printing quality, it is complex in structure and high in manufacturing cost. Also, it is difficult to assure the quality of the pressure regulator mechanism.

SUMMARY OF THE INVENTION

It is an object of the present invention to provide an ink cartridge without absorption material, which is simple in structure, reliable in performance and ink refillable for ink-jet printer.

To accomplish the above-mentioned objects of the present invention: an ink cartridge for ink-jet printer comprises an ink storage chamber formed by a cartridge body and a cartridge cover and an ink supply adjusting valve located inside the ink storage chamber. The ink storage chamber has an ink-filling port, an ink-supply port and an air vent at one end of which a valve is mounted. The ink supply adjusting valve includes a valve body, an ink inlet, which communicates in ink fluid communication with the ink storage chamber as well as an ink outlet, which is connected with the ink-supply port of ink storage chamber; and a valve body, which is constructed of a film and holder thereof and in which at least two small ink chambers are partitioned and both of the small ink chambers are communicated by means of one or more small ink channels.

One-way valve is provided at the air vent on the cartridge cover for maintaining a stable negative pressure inside the entire ink cartridge. Such a normally closed one-way valve is constructed of a valve cap made of elastic material such as rubber and a rigid valve base integrated with the box cover. The valve extends to the vicinity of bottom surface of the ink storage chamber and stays under the level of ink fluid for most of the time during the life span of ink cartridge.

The bottom surface of ink storage chamber of ink cartridge has one or more recessions where the ink inlet of adjusting valve extends to the lowest portion of the recession in order to fully extract the ink inside the ink chamber.

The ink supply adjusting valve in accordance to the present invention is simple in structure, reliable in adjusting effect, independent in assemblage, good in printing effect if it is combined with an ink cartridge constructed of normally closed one-way valve and ink storage chamber with recessions, high in utilization of ink as well as low in cost of manufacturing ink cartridge.

BRIEF DESCRIPTION OF THE DRAWINGS

The present invention will be more clearly understood with reference to the following embodiments taken in connection with the accompanying drawings, in which.

DESCRIPTION OF THE PREFERRED EMBODIMENT

Figure 1:
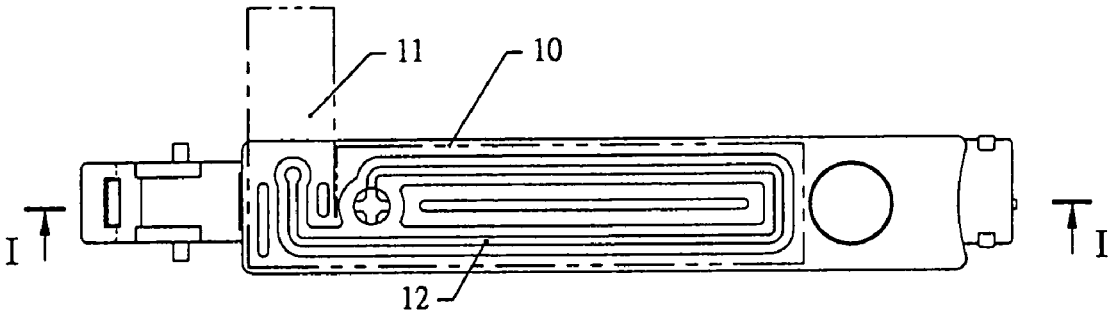
FIG. 1 is a top view of ink cartridge of the present invention.

Referring to FIG. 1–7, an ink cartridge in accordance with the present invention consists of a cartridge body 6, a cartridge cover 7, an ink supply adjusting valve 4, an air vent one-way valve 14 with a valve cap 15, a sealing member 3, a sealing film 2, a sealing plug 8 for ink-filling port, a plastic film 9 for ink-filling port, a plastic film 10 for air vent, etc. The ink supply adjusting valve 4 consists of front and rear films 20, 19, valve body 17 and filter mesh 18, wherein an ink inlet 22 with elongated structure and an ink outlet 21 with larger caliber are provided at the lower portion of the adjusting valve 4. The ink inlet 22 is designed as an elongated structure in order to form damping orifice, thereby reducing ink flow and pressure flowing from ink storage chamber into the valve. Ten square through-holes, which pass through the front and rear surfaces of the valve body, are evenly distributed on the valve body 17, and eight pairs of grooves with "U" section are distributed symmetrically on the front and rear surfaces of adjacent through-holes. Also, each pair of grooves is orderly communicated with their through-holes in the manner of from ink inlet to ink outlet and from bottom meanderingly to top. Filter mesh 18 is welded inside a orifice nearby the ink outlet 21 where in the mesh spacing is extremely small (approximately 0.02~0.1 mm) and serves as filtering the ink impurities; meanwhile, it also enables the ink to form rift flow in order further to reduce the ink flow and pressure flowing from inside of the valve to ink outlet. Front and rear films 20, 19 are symmetrically welded to the front and rear surfaces of the valve body 17, thus forming small ink chamber 23 on the square through-holes of the valve body and allowing the grooves to form elongated structures (small ink channels 24), and also to form damping orifices within the valve; meanwhile, an ink flowing channel with a variable section constructed in series by dual ink channels is formed in the valve body from ink inlet to a small ink channel before one welded by the filter mesh. Small ink chambers are interconnected by means of dual ink channels in order to assure free flowing and continuity of ink movement inside the valve. The aforesaid structure controls the flow and pressure of ink inside the valve properly and effectively.

The air vent one-way valve 14 is normally closed, which consists of a valve cap 15 made of resilient material such as rubber or silicon rubber and a rigid valve base integrated with the cartridge cover 7, and extends to the vicinity of the bottom surface of ink storage chamber staying under the level of ink fluid for most of the time during the life span of the ink cartridge, as well as is reliably closed by the assistance of ink liquid surface tension.

A recessed portion is provided on the bottom surface of ink storage chamber 13 of the ink cartridge, into which the ink inlet 22 of the ink supply adjusting valve 4 extends in order to fully extract the ink 5 inside the ink storage chamber 13. A hole is also provided on the bottom surface of the ink storage chamber 13, which is communicated with the ink outlet 21 of the ink cartridge and used for installing ink supply adjusting valve 4, where the ink outlet 21 of the adjusting valve communicates with ink-supply port 16 of ink cartridge through the said hole.

Before installing the ink cartridge to the printer, the peeling section 11 of air vent plastic film should be kept, as shown in FIG. 1. At this moment, the peeling section 11, air vent plastic film 10, sealing plug 8, sealing film 2, cartridge body 6, cartridge cover 7 are all together to form a completely sealed space in order to maintain inside the ink storage chamber 13 a larger negative air pressure value relative to the outside atmosphere. The air vent communicated with the one-way valve 14 is constructed of the peeling section 11 of air vent rubber sheet, air vent rubber sheet 10, and vent groove 12 formed on the surface of the cartridge cover where meandered vent groove not only reduces the possibility of ink overflow after peeling section 11 is removed, but also controls the speed of outside air entering the chamber and prevents ink inside the air vent one-way valve from evaporating, drying up, whereby, lowering the reliability of valve operation.

Figure 2:
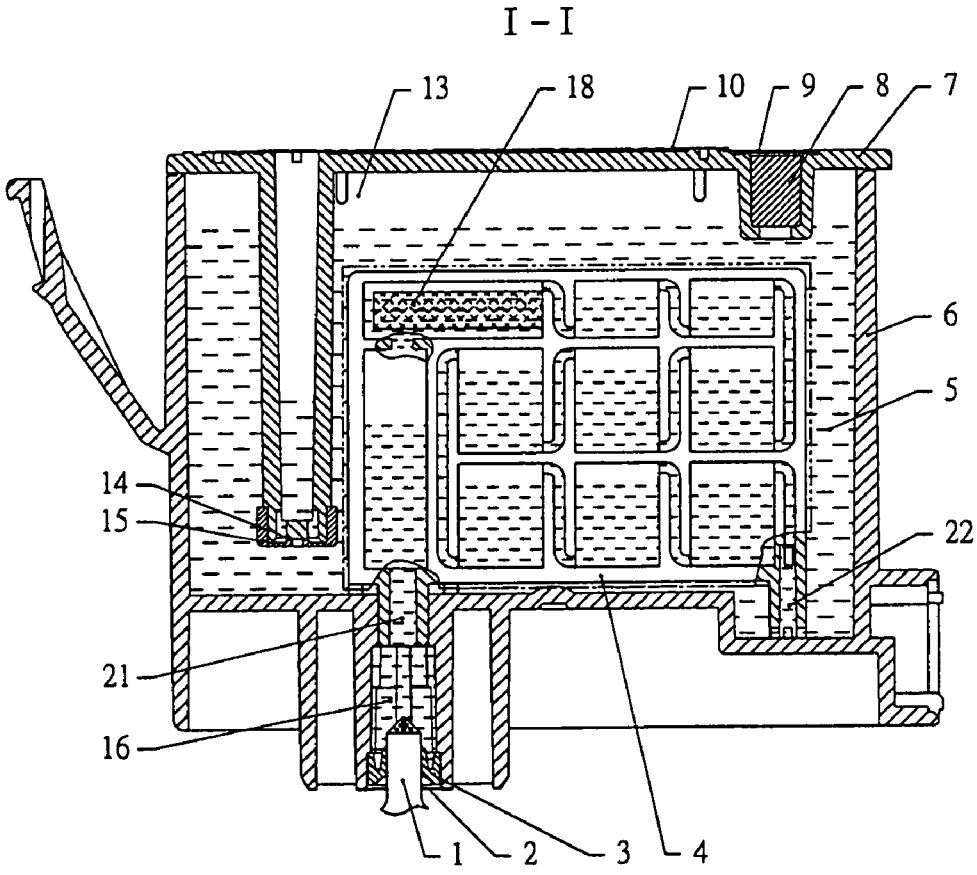
FIG. 2 is a sectional view of ink cartridge taken on line I—I in FIG. 1 in combination with the ink supply needle of the printer.
Figure 3:
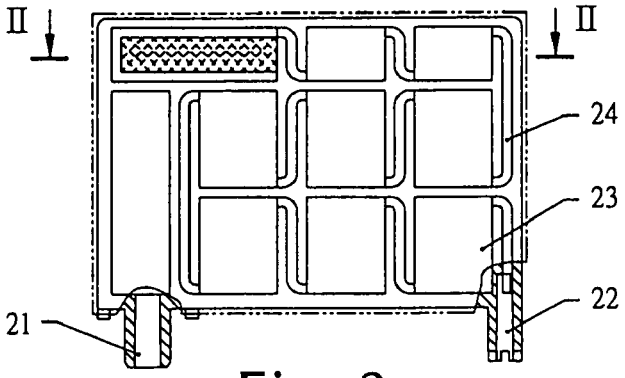
FIG. 3 is a main view of ink supply adjusting valve located inside ink storage chamber.
Figure 4:
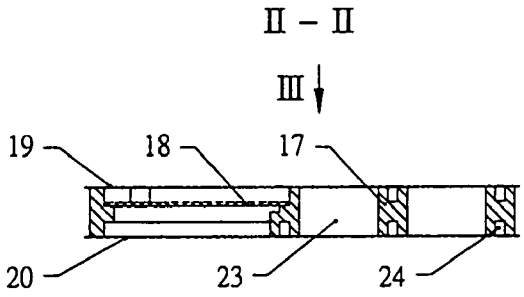
FIG. 4 is a sectional view of ink supply adjusting valve taken on line II—II in FIG. 3.
Figure 5:
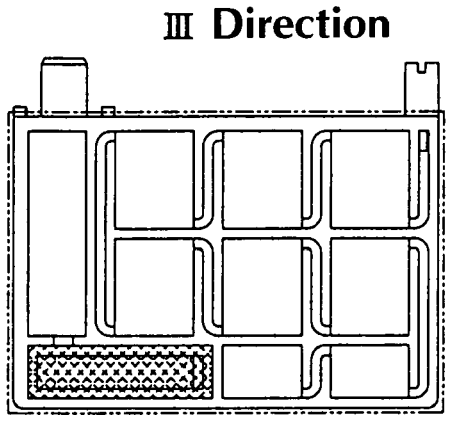
FIG. 5 is a sectional view of ink supply adjusting valve in III direction.
Figure 6:
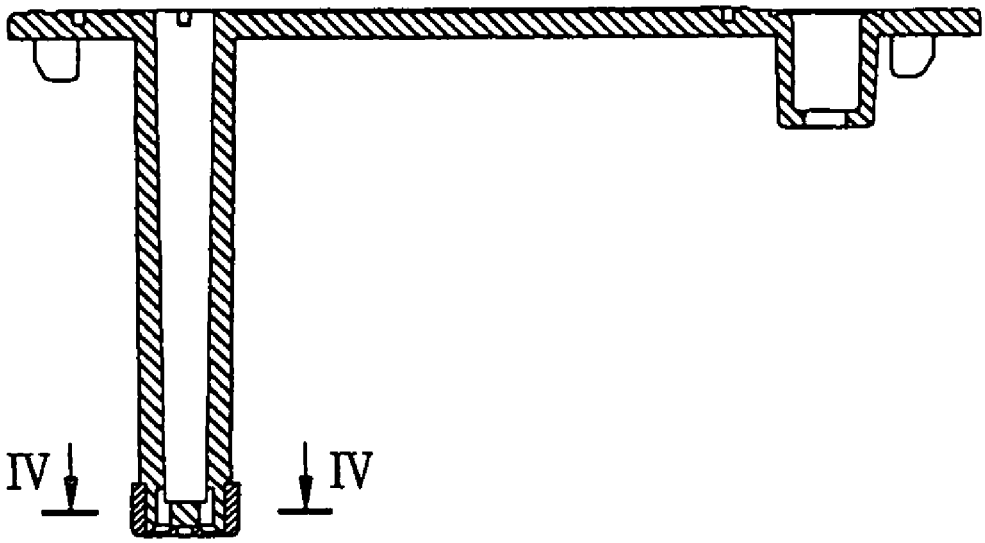
FIG. 6 is a sectional view of air vent one-way valve and the cartridge cover.
Figure 7:
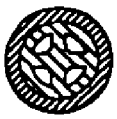
FIG. 7 is a sectional view of air vent one-way valve taken on line IV—IV in FIG. 6.

Before the ink cartridge is loaded into the printer, peeling section 11 of the air vent plastic film needs to be taken off first. FIG. 2 shows that the ink cartridge has been attached to the printer; at this moment, ink outlet needle 1 of the print head punctures the sealing film 2 and then enters into the sealing member 3 of the ink-supply port 16 of ink cartridge. While the printer is in non-operating mode, air vent one-way valve 14 is under normally closed status. At this moment, the atmosphere pressure acting on the outside of valve is equal to the sum of the pressure inside the ink storage chamber 13, elastic retraction of air vent one-way valve cap 15 acting on the surface of center protuberant table of the valve base and tension of ink inside the rift of valve; therefore, pressure inside the ink cartridge is slightly less than the outside atmospheric pressure, thus maintaining the inside thereof under a suitable negative pressure and the ink under static equilibrium. Thus, it prevents the ink 5 from leaking through the ink outlet needle 1 of the print head.

When the print head is operating, a low pressure area inside the ink outlet 21 of ink cartridge is, first of all, formed due to suction from the print head, and then such low pressure area rapidly and orderly spreads to the adjusting valve 4, and ink storage chamber 13. At the same time, the two films 20, 19 symmetrically welded on front and rear surfaces of the adjusting valve 4 became inwardly concave, whereby reducing the capacity inside the ink supply adjusting valve 4. As a result, the pressure therein rises, whereby allowing part of the ink inside the valve to flow to the ink outlet 21 of ink cartridge and to increase the ink flow properly. When the low pressure area spreads to the ink storage chamber 13, the valve is opened as the atmospheric pressure outside the air vent one-way valve 14 is higher than the closing force of air vent one-way valve 14 and surface tension of the ink 5. As ink pressure inside the chamber rises, the ink inside the ink cartridge flows from ink storage chamber 13 to ink supply adjusting valve 4, then to the ink-supply port 16 of ink cartridge, and finally to enter into the ink outlet needle 1 of print head. The ink supply adjusting valve 4 with varying section of ink flow channel 24 further adjusts the ink flow and pressure therein properly.

When the print head ceases to operate, the front and rear films 20, 19 automatically reposition as suction of inwardly concave disappears. Under this circumstance, the volume within the ink supply adjusting valve 4 increases and the pressure decreases, whereby allowing ink within the valve to stop flowing outward, and small amount of ink outside the ink supply adjusting valve 4 flows into the valve from ink inlet 22 and ink outlet 21 respectively, until ink pressure inside and outside the ink supply adjusting valve 4 is in equilibrium and adequate amount of ink is stored inside the valve, as shown in FIG. 2. Meanwhile, the air vent one-way valve 14 is back to normally closed status and the inside of the ink cartridge is back to negative pressure status. Under this condition, a new static equilibrium of ink is established.

As aforesaid, in the ink cartridge in accordance with the present invention, the ink flow and pressure are adjusted by means of specifically structured ink flow channel inside the ink supply adjusting valve 4, in which fine control of the ink flow is performed through extension-retraction of the films 20, 19 similar to the porous sponge, and the pressure inside the entire chamber is kept and controlled by means of the normally closed air vent one-way valve 14, thus adjusting the ink flow and pressure in the ink outlet needle 1 of the print head properly and timely.

Moreover, since there is no absorption material mesh 18 such as sponge within the ink cartridge, and ink filtering area of ink filter mesh 18 is larger, such filter gauze is not easy to be blocked subject to multiple filtrations. Therefore, when ink is completely consumed, the ink cartridge is taken out from the printer and the sealing plug 8 is pulled out. After that, the ink cartridge may be refilled with ink. Once refilled up and the sealing plug is pushed therein, it may continue to be used. Thus, cycle use of the ink cartridge in accordance with the present invention can be carried out and it is long in working life.

What is claimed is:

1. An ink cartridge for ink-jet printer, comprising:

an ink storage chamber formed by an ink cartridge body and an ink cartridge cover, on which an ink-filling port and an ink-supply port are provided;

an air vent at one end of which an one-way valve is mounted; and an ink supply adjusting valve located inside the ink storage chamber, characterized in that the ink supply adjusting valve includes an ink inlet, which communicates in ink fluid communication with the ink storage chamber;

an ink outlet, which is connected with the ink-supply port of the ink storage chamber; and the ink supply adjusting valve, which is constructed of films and a valve body thereof and in which at least two small ink chambers are partitioned, and both of the small ink chambers are communicated by means of one or more small ink channels.

2. The ink cartridge for ink-jet printer according to claim 1, wherein a filter mesh is provided in the small ink chamber.

3. The ink cartridge for ink-jet printer according to claim 2, wherein the one-way valve is a normally closed one-way valve.

4. The ink cartridge for ink-jet printer according to claim 3, wherein the one-way valve consists of a rigid valve base located at the end of the air vent and a valve cap jacketed on the valve base.

5. The ink cartridge for ink-jet printer according to claim 1, wherein the air vent valve lies under the level of ink fluid of the ink storage chamber.

6. The ink cartridge for ink-jet printer according to claim 1 wherein the air vent valve is a normally closed one-way valve.

7. The ink cartridge for ink-jet printer according to claim 6, wherein the one-way valve consists of a rigid valve base located at the end of the air vent and a valve cap jacketed on the valve base.

8. The ink cartridge for ink-jet printer according to claim 1, wherein the ink inlet of the ink supply adjusting valve is located at a lowest portion of the ink storage chamber.

9. The ink cartridge for ink-jet printer according to claim 8, wherein the lowest portion is a recessed portion of the ink storage chamber.

* * * * *